US008867982B2

(12) United States Patent
Kojima

(10) Patent No.: US 8,867,982 B2
(45) Date of Patent: Oct. 21, 2014

(54) IMAGE FORMING APPARATUS AND DOUBLE-SIDED IMAGE FORMING APPARATUS

(75) Inventor: Yuya Kojima, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 683 days.

(21) Appl. No.: 12/471,897

(22) Filed: May 26, 2009

(65) Prior Publication Data

US 2009/0297173 A1 Dec. 3, 2009

(30) Foreign Application Priority Data

May 30, 2008 (JP) ..... 2008-142836
May 14, 2009 (JP) ..... 2009-117594

(51) Int. Cl.
*G03G 15/00* (2006.01)
*G03G 15/14* (2006.01)
*G03G 15/16* (2006.01)
*G03G 15/23* (2006.01)

(52) U.S. Cl.
CPC ..... *G03G 15/234* (2013.01); *G03G 2215/0132* (2013.01); *G03G 15/1605* (2013.01)
USPC ..... 399/401; 399/66; 399/389

(58) Field of Classification Search
USPC ..... 399/306, 401, 66, 53, 388, 389, 391
See application file for complete search history.

(56) References Cited

U.S. PATENT DOCUMENTS

| | | | | |
|---|---|---|---|---|
| 7,174,111 | B2 * | 2/2007 | Koga et al. | 399/66 |
| 2004/0086288 | A1 * | 5/2004 | Wibbels | 399/45 |
| 2004/0190927 | A1 * | 9/2004 | Tsukamoto et al. | 399/82 |
| 2007/0014609 | A1 * | 1/2007 | Kida et al. | 399/401 |

FOREIGN PATENT DOCUMENTS

| | | |
|---|---|---|
| JP | 10-194529 | 7/1998 |
| JP | 2002-244524 A | 8/2002 |
| JP | 2007-65411 | 3/2007 |

* cited by examiner

*Primary Examiner* — Matthew G Marini
(74) *Attorney, Agent, or Firm* — Fitzpatrick, Cella, Harper & Scinto

(57) ABSTRACT

An image forming apparatus has an intermediate transfer member onto which an image is transferred, a transfer part transferring the image formed on the intermediate transfer member onto a transfer, a detection part detecting a transfer which is conveyed, a both-surface conveying part reversing the transfer with an image being formed on a first surface, and conveying the transfer to the transfer part again, and a control wherein a timing when forming an image on a second surface of the transfer by the image forming part is set based on a time necessary to reverse the transfer material and a size in a conveying direction of a transfer material.

12 Claims, 10 Drawing Sheets

IMAGE FORMING APPARATUS AND DOUBLE-SIDED IMAGE FORMING APPARATUS

BACKGROUND OF THE INVENTION

1. Field of the Invention

The present invention relates to an image forming apparatus, and particularly relates to an image forming apparatus for forming an image on both surfaces of a transfer material.

2. Description of the Related Art

A configuration of a conventional image forming apparatus will be described hereinafter.

<Configuration of Color Image Forming Apparatus>

FIG. 8 is a schematic entire configuration diagram illustrating one example of a laser printer as a color image forming apparatus. The image forming apparatus forms an electrostatic latent image by an image light which is formed based on an image signal transmitted from a controller part not illustrated in an image forming part (image forming unit) as illustrated in FIG. 8, and develops the electrostatic latent image and superimposes and transfers a visible image to form a color visible image. The image forming apparatus transfers the color visible image onto a transfer material and fixes the color visible image on the transfer material. The image forming part is configured by photosensitive drums 5Y, 5M, 5C and 5K as a plurality of image bearing members for development colors arranged in parallel at each station, and charging devices 7Y, 7M, 7C and 7K as primary charge members. Further, the image forming part is configured by developing devices 8Y, 8M, 8C and 8K as developing means, an intermediate transfer belt 12 as an intermediate transfer member, a transfer part (transfer unit) to be a secondary transfer position 13, a fixing device 14 (fixing unit), a feeding sheet roller 19 and a registration roller 20.

The photosensitive drums 5Y, 5M, 5C and 5K, the charging devices 7Y, 7M, 7C and 7K, and the developing devices 8Y, 8M, 8C and 8K are loaded on toner cartridges 10Y, 10M, 10C and 10K which are attachable to and detachable from an image forming apparatus main body.

The photosensitive drums 5Y, 5M, 5C and 5K are formed by coating outer peripheries of aluminum cylinders with an organic optical conductive layer, and rotate by a drive force of a drive motor not illustrated being transmitted to the photosensitive drums. The drive motor rotates the photosensitive drums 5Y, 5M, 5C and 5K in a counter-clockwise direction in correspondence with an image forming operation. Exposure light to the photosensitive drums 5Y, 5M, 5C and 5K are configured to be sent from scanner parts 9Y, 9M, 9C and 9K, and selectively expose surfaces (on the image bearing members) of the photosensitive drums 5Y, 5M, 5C and 5K to thereby form an electrostatic latent image.

The primary charge member is configured by including the four electric charging devices 7Y, 7M, 7C and 7K for charging the photosensitive drums of yellow (Y), magenta (M), cyan (C) and black (K) at each station. The respective charging devices 7Y, 7M, 7C and 7K include sleeves 7YS, 7MS, 7CS and 7KS.

The developing means has a configuration including four developing devices 8Y, 8M, 8C and 8K which perform development of yellow (Y), magenta (M), cyan (C) and black (K) at each station to visualize an electrostatic latent image. The developing devices 8Y, 8M, 8C and 8K are provided with sleeves 8YS, 8MS, 8CS and 8CK, respectively.

The intermediate transfer belt 12 is in contact with the photosensitive drums 5Y, 5M, 5C and 5K, and rotates in a clockwise direction with rotation of the photosensitive drums 5Y, 5M, 5C and 5K at the time of color image formation to be subjected to transfer (primary transfer) of a visible image. Further, by holding and conveying a transfer material, the intermediate transfer belt 12 superimposes and transfers (multiple-transfers) the transfer material and a color visible image (multicolor toner image) on the intermediate transfer belt 12 at the same time.

A transfer part to be a secondary transfer position 13 is in contact with the intermediate transfer belt 12. The transfer part rotates in a counterclockwise direction with rotation of the intermediate transfer belt 12, and transfers (secondary transfer) the color visible image on the intermediate transfer belt 12 (on the intermediate transfer member) to the transfer material conveyed from the registration roller 20.

A feeding sheet sensor 21 detects whether a transfer material 2 which is fed from a sheet feeding cassette 1 reaches the feeding sheet sensor 21 within a predetermined time. A conveyance failure of the transfer material 2 at the time of sheet feeding can be detected from the detection result. A registration sensor 22 is provided for synchronizing the image formed on the intermediate transfer belt 12 and the transfer material 2 which is fed. The transfer material 2 is temporality stopped at the timing when a leading end of the transfer material 2 is sensed by the registration sensor 22, and the timing at which the transfer material 2 is conveyed again is controlled so that the image formed on the intermediate transfer belt 12 is transferred to a predetermined position of the transfer material 2. A prefixing sensor 23 and a fixing and discharging sensor 24 are also provided. Further, the fixing device 14 has a pressure roller 16 and a fixing roller 15, and a heater 17 is provided in the fixing roller. A thermistor 18 detects the surface temperature of the fixing roller 15, and energization to the heater 17 is controlled based on the detection result. A discharging sheet roller 25 discharges the transfer material 2. Further, a reversing flapper 26 switches a conveyance path of the transfer material 2 to form images on both surfaces of the transfer material 2.

<System Configuration of Image Forming Apparatus>

FIG. 9 is a block diagram for describing a schematic system configuration of a laser printer as an image forming apparatus. A controller control part 201 can mutually communicate with a host computer 200 and an engine control part 202 (220, 222 of FIG. 9).

The controller control part 201 receives image information and printing conditions from the host computer 200. The controller control part 201 transmits a printing reservation command for making reservation of a printing operation with printing information of each transfer material being added to the engine control part 202 based on the received printing conditions, and analyzes the received image information and converts the image information into bit data. Here, the printing information of each transfer material includes, for example, a sheet feeding port (sheet feeding cassette), a transfer material size, a printing mode and the like. The controller control part 201 transmits a printing start command for instructing start of printing operation to the engine control part 202 at a point of time when analysis of the image information is finished. When receiving the printing start command, the engine control part 202 outputs a /TOP signal (221 of FIG. 9) to be a reference timing of output of the video signal for a first station which is an image forming part of yellow. Subsequently, the engine control part 202 starts a sheet feeding operation, and causes the fed transfer material 2 to be temporarily on standby with the registration roller 20. Thereafter, the engine control part 202 feeds the transfer material 2 again from the registration roller 20 in synchronism with the toner image formed on the intermediate transfer belt 12 reaching the secondary transfer position 13. The engine control part 202 includes a video interface part 210, a CPU 211, an image processing GA 212, an image control part 213, a fixing control part 214, a sheet conveyance part 215 and a drive control part 216.

<Timing Chart of Both-Surface Printing>

FIG. 10 shows a timing chart of a case of realizing the highest throughput in both-surface printing (both-surface printing). The timing chart illustrates the /TOP signal (/TOP), drive of the registration roller 20 (registration roller drive), pick-up operation of the transfer material 2, a detection signal and reversing operation by the registration sensor 22 (reversing unit), and a detection signal by the fixing and discharging sensor 24. Further, in correspondence with each point of time illustrated by the broken line on the timing chart, the state of the image forming apparatus is illustrated in the order of (a) to (e) in FIG. 10. The throughput means the image formation number (the number of printing sheets) per unit time, and in order to realize the highest throughput, a time interval (see 300 of FIG. 10) between output of the /TOP signal of the first surface and output of the /TOP signal of the second surface needs to be the shortest.

On receiving a printing start command from the controller control part 201, the engine control part 202 prepares for printing, and outputs the /TOP signal of the first surface (311) when the preparation is made ((a) of FIG. 10), and starts a sheet feeding operation of the transfer material 2 (312). The engine control part 202 temporarily stops conveyance of the transfer material 2 (314) at a point of time (313) when the transfer material 2 which is picked up reaches the registration roller 20 where the registration sensor 22 is arranged. The engine control part 202 restarts (315) conveyance of the transfer material 2 in synchronism with a toner image t1 formed on the intermediate transfer belt 12 ((b) of FIG. 10), and transfers the toner image t1 onto the transfer material 2. The engine control part 202 thermally fixes the toner image t1 onto the transfer material 2 by the fixing device 14.

Thereafter, the engine control part 202 transfers the transfer material 2 to the position where a rear end of the transfer material 2 comes out of the fixing and discharging sensor 24 and the transfer material 2 can be reversed at 316 ((c) of FIG. 10), and starts the reversing operation by turning on (ON) the reversing flapper 26 and a reversing solenoid not illustrated (317) ((d) of FIG. 10). Next, the conveyance path is switched to the both-surface path by the reversing flapper 26 and the transfer material 2 is conveyed to the both-surface path. The engine control part 202 temporarily stops (324) conveyance of the transfer material 2 at a point of time (323) when the reversed transfer material 2 reaches the registration roller 20. Subsequently, the engine control part 202 restarts (325) conveyance of the transfer material 2 ((e) of FIG. 10) in synchronism with a toner image t2 of the second surface formed on the intermediate transfer belt 12, and transfers the toner image t2 onto the transfer material 2.

An output timing (321) of the /TOP signal of the second surface for realizing the highest throughput is determined with the following time as the reference based on the transfer material size designated to the engine control part 202 by the controller control part 201. More specifically, the output timing is determined by back calculation with the time in which the toner image t1 of the first surface is transferred onto the transfer material 2 at the secondary transfer position 13, and the transfer material 2 is reversed (317) and reaches the registration roller 20 again (323) as the reference.

As described above, the output timing of the /TOP signal of the second surface is determined by back calculation from the timing in which the second surface of the transfer material is reversed and reaches the registration roller 20 based on the transfer material size designated by the controller control part 201. Therefore, when the size in the conveying direction of the transfer material 2 which is actually set at the sheet feeding cassette 1 which is the sheet feeding port is larger than the transfer material size designated by the controller control part 201, the timing at which the transfer material 2 is reversed is later than the assumed timing. As a result, the transfer material 2 does not reach the registration roller 20 by the timing at which the toner image t2 of the second surface formed on the intermediate transfer belt 12 reaches the secondary transfer position 13, and detention of the transfer material 2, and sheet jamming (jam) occur.

Therefore, for example, Japanese Patent Application Laid-open Nos. H10-194529 and 2007-065411 avoid occurrence of jam as follows. Specifically, the size (length) in the conveying direction of the transfer material fed to the first surface is detected by using a sensor on the transfer material conveyance path. When the detected size in the conveying direction of the transfer material and the designated size in the conveying direction of the transfer material do not match with each other, a print error due to sheet size mismatch, which means a failure in printing, is output. The transfer material is discharged outside the apparatus, and printing operation is stopped, whereby removal processing of the transfer material by a user which is necessary when it is jammed is made unnecessary.

However, in each of the apparatuses of the conventional examples described above, if both-surface printing is carried out when the size in the conveying direction of the transfer material which is fed is larger than the designated size, a printing error due to mismatch of sheet size occurs. Therefore, when the error is determined, the toner image of the second surface remains on the intermediate transfer belt 12, and therefore, the toner is wasted. Further, as compared with the case of normal termination, much time is required for an operation of recovering the wasted toner.

SUMMARY OF THE INVENTION

The present invention is made in view of the above described problem.

A purpose of the invention is to provide an image forming apparatus, an image forming part that forms an image on an image bearing member, an intermediate transfer member onto which the image formed on the image bearing member is transferred, a transfer part that transfers the image formed on the intermediate transfer member onto a transfer material, a detection part that detects the transfer material which is conveyed before the image is transferred by the transfer part, a conveying part that reverses the transfer material of which an image is formed on a first surface of the transfer material, and conveys the transfer material to the transfer part again, and a control part that controls a timing of starting image formation by the image forming part, based on a designated size in a conveying direction of a transfer material, wherein the control part sets a timing of starting image formation onto a second surface of the transfer material by the image forming part, based on the designated size in the conveying direction of the transfer material and a size in a conveying direction of a conveyed transfer material.

A further purpose of the invention is to provide a double-sided image forming apparatus forming images on both surfaces of a transfer material, including an intermediate transfer member onto which an image formed on an image bearing member by an image forming part is transferred, a transfer part that transfers the image formed on the intermediate transfer member onto a transfer material, a detection part that detects the transfer material; which is conveyed before the image is transferred by the transfer part, and a both-surface conveying part that reverses the transfer material with an image formed onto a first surface, and conveys the transfer material to the transfer part again, wherein a timing of image formation by the image forming part when an image is formed onto a second surface of the transfer material, is switched based on a designated size in the conveying direction of the transfer material and a size in a conveying direction of a conveyed transfer material.

A still further purpose of the invention will become apparent from the following description of exemplary embodiments with reference to the attached drawings.

DESCRIPTION OF THE EMBODIMENTS

Hereinafter, an image forming apparatus according to embodiments of the present invention will be described in detail with use of the drawings. It is to be understood that exemplary embodiments shown as follows are only examples, and the technical range of the present invention is not limited to the disclosed exemplary embodiments.

Embodiment 1

Figure 8:
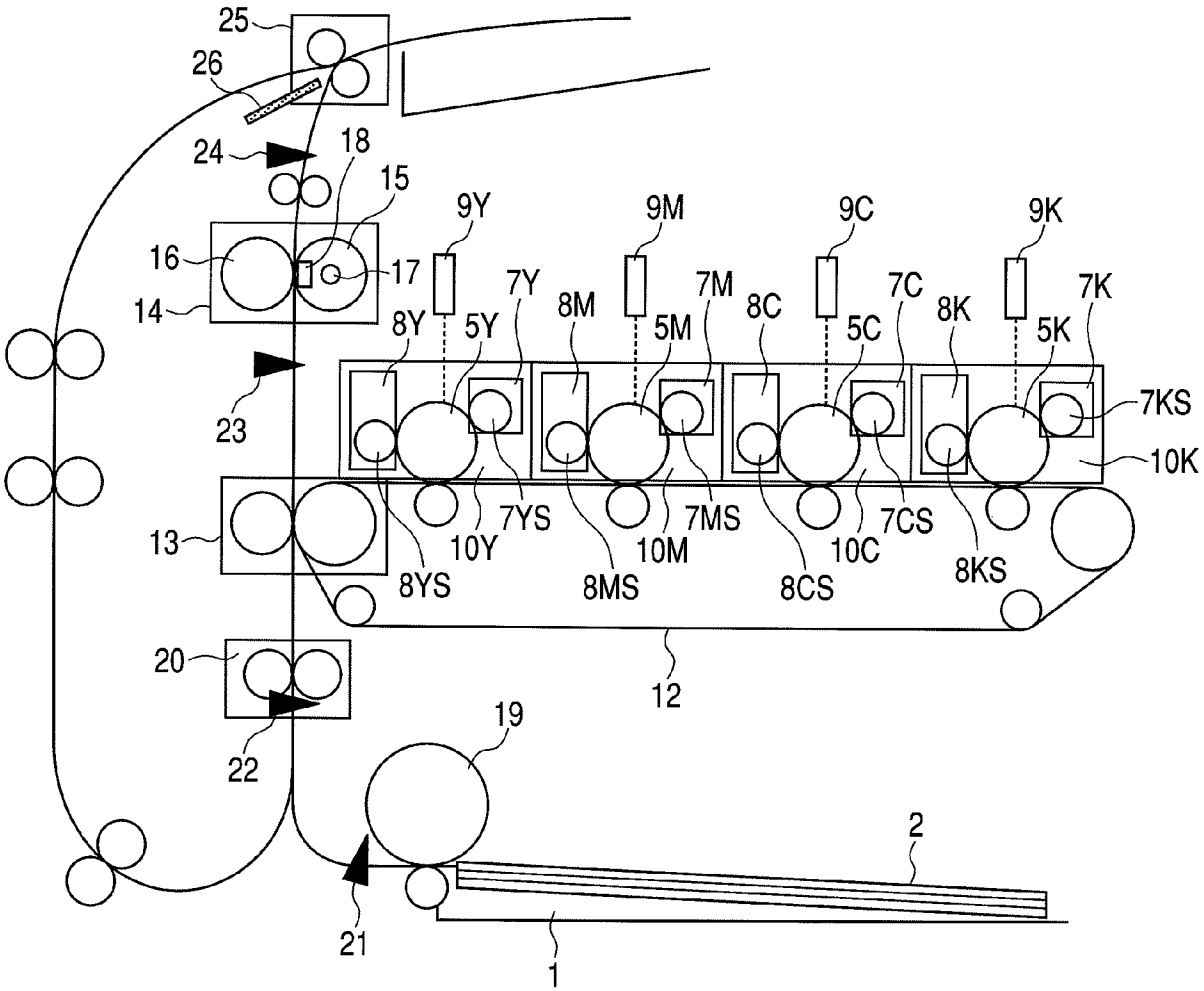
FIG. 8 is an entire configuration diagram of a laser printer as an image forming apparatus.
Figure 9:
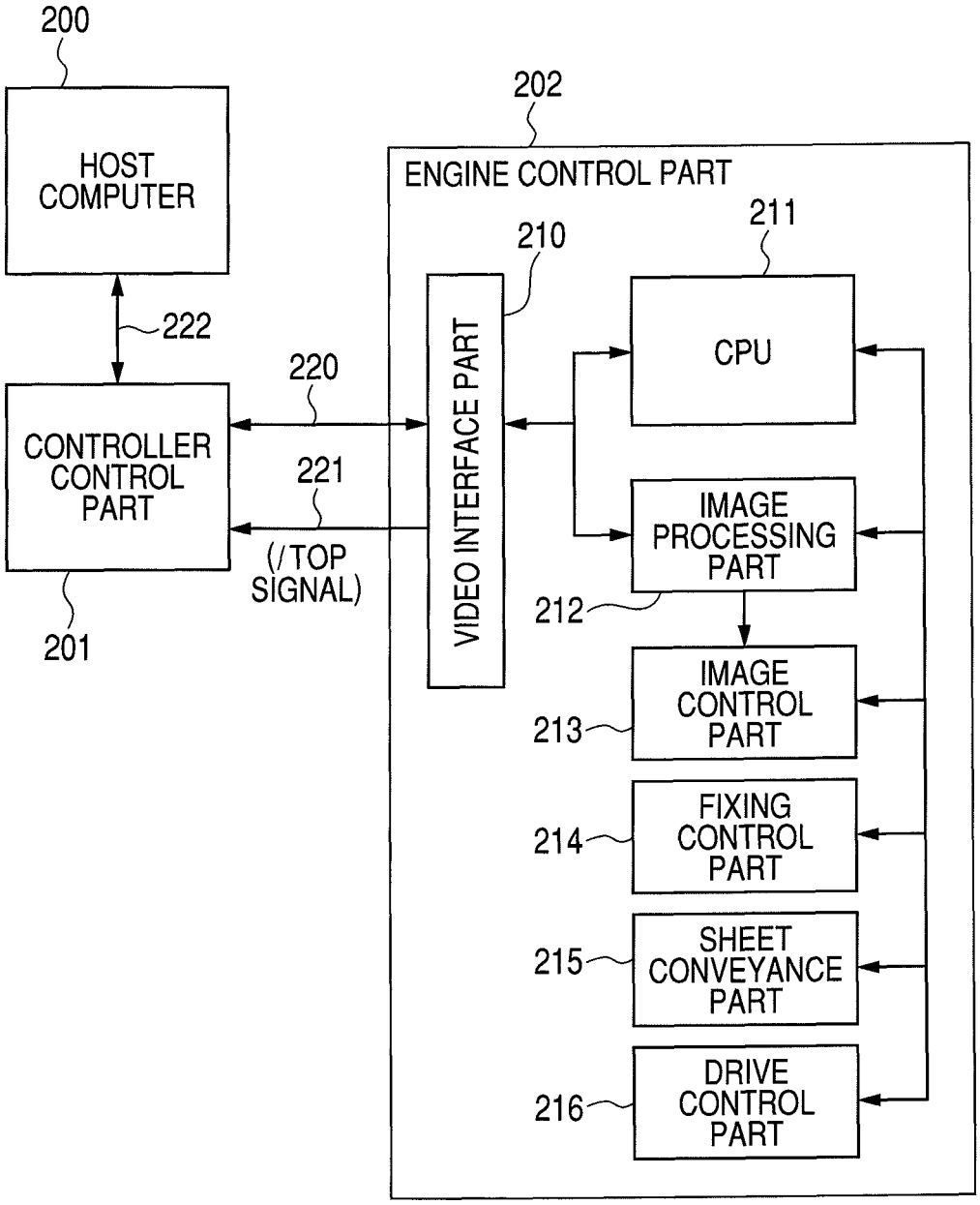
FIG. 9 is a block diagram describing a schematic system of the laser printer as the image forming apparatus.
Figure 10:
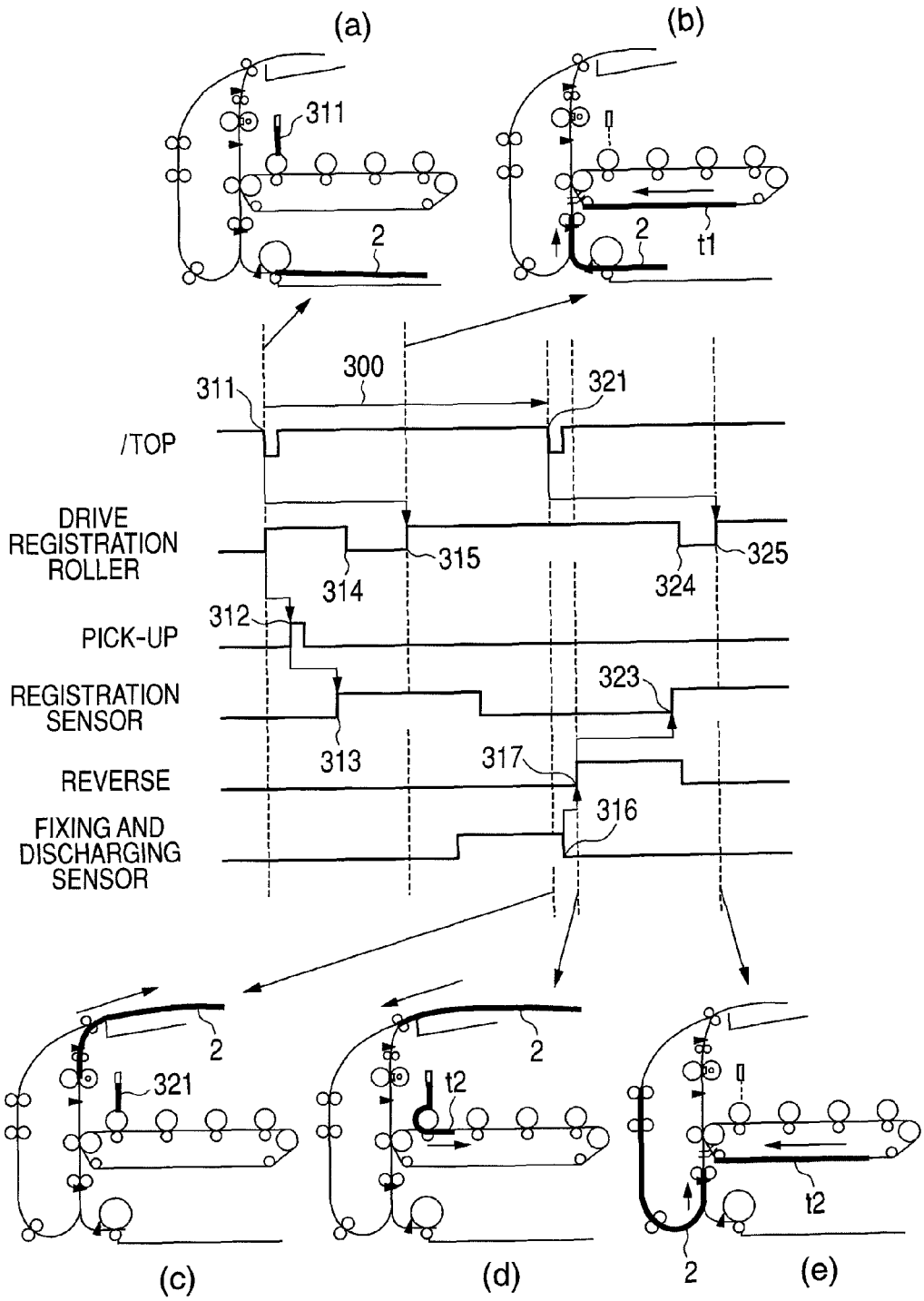
FIG. 10 is a timing chart for realizing the highest throughput at a time of both-surface printing in a conventional example.

An image forming apparatus in the present embodiment has the same components as described with the aforementioned FIGS. 8 and 9. Therefore, the description of the components will be omitted, and the image forming apparatus will be described by using the same reference numerals and characters hereinafter.

Figure 1:
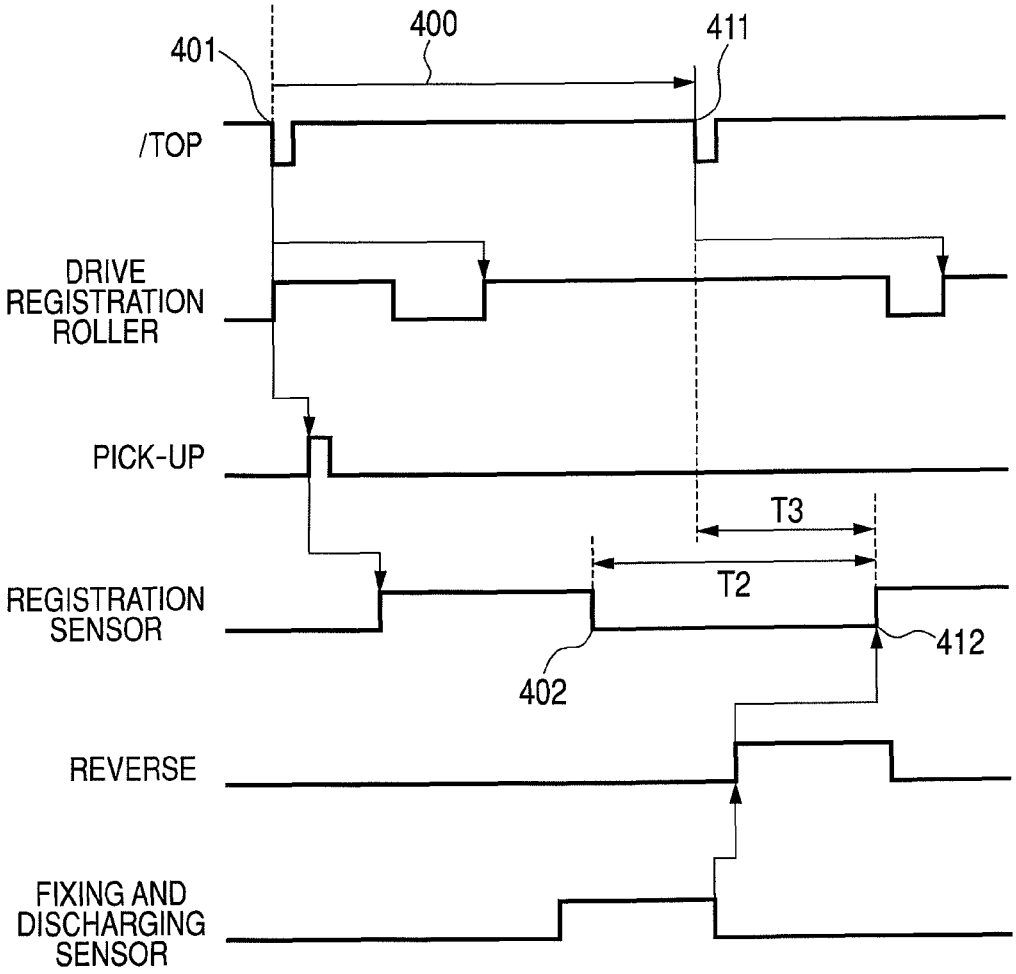
FIG. 1 is a diagram illustrating a basic operation at a time of both-surface printing in embodiment 1.

The image forming apparatus in the present embodiment has the following configuration. Specifically, the time until a leading end of a toner image reaches a secondary transfer position 13 after image formation is started is shorter than the time after a rear end of a first surface of a transfer material 2 (hereinafter, called "sheet 2") comes out of a registration sensor 22 and is reversed until a leading end of a sheet after inversion reaches the secondary transfer position 13. In the image forming apparatus with such a configuration, in the present embodiment, the engine control part 202 (determining unit) determines a timing for outputting a /TOP signal of a second surface with the timing at which the rear end of the first surface of the sheet 2 comes out of the registration sensor 22 as the reference. Thereby, even when the size in the conveying direction of the sheet 2 which is actually set at the sheet feeding cassette 1 is larger than the size designated by the controller control part 201, a printing error due to a conveyance failure such as detention and sheet jamming (hereinafter, called jam) of the sheet 2 or mismatch of the sheet size is not caused. Further, both-surface printing can be performed with the highest throughput corresponding to the size of the sheet set at the sheet feeding cassette 1 (the time interval of 400 in FIG. 1 is made as short as possible). The details will be described hereinafter.

<Basic Operation of Second Surface at the Time of Both-Surface Printing>

FIG. 1 is a timing chart illustrating a basic both-surface printing operation. Based on FIG. 1, the output timing of the /TOP signal of the second surface in the present embodiment will be described. When attention is focused on the behavior of the sheet 2 during both-surface printing, a time T2 until the rear end of the sheet comes out of the registration sensor 22 at the time of image formation of the first surface (402), and is reversed to reach the registration sensor 22 again (412) is constant irrespective of the length (hereinafter, described as the sheet size) in the conveying direction of the sheet 2. Further, the /TOP signal for the second surface is output at a timing (411) which is obtained by performing back calculation so that the highest throughput is realized based on the timing (412) at which the inversed sheet 2 reaches the registration sensor 22 with the /TOP signal output timing (401) of the first surface as a starting point. Since the timing depends on the length of the intermediate transfer belt 12, a time T3 until the reversed sheet reaches the registration sensor 22 (412) after the /TOP signal output timing (411) of the second surface is constant irrespective of the sheet size. In the configuration in which the time until the leading end of the toner image reaches the secondary transfer position 13 after start of image formation is shorter than the time until the leading end of the reversed sheet reaches the secondary transfer position 13 after the rear end of the first surface of the sheet comes out of the registration sensor 22 and is reversed, T2>T3 is satisfied. The timing chart of FIG. 1 illustrates control which is conducted when the size in the conveying direction of the sheet is the same as the designated sheet size, which is the basic operation at the time of both-surface printing.

In the present embodiment, when the sheet size of the conveyed sheet 2 is larger than the designated sheet size, the /TOP signal output timing of the second surface is set as a timing at which a predetermined time has passed after the timing (402) at which the sheet 2 comes out of the registration sensor 22. Thereby, both-surface printing can be performed with the highest throughput corresponding to the sheet size without causing a printing error. The throughput is determined by a time interval of 400 in FIG. 1. When the time interval of 400 is short, the throughput becomes large, whereas when the time interval is long, the throughput becomes small. Hereinafter, the characteristic operation of the present embodiment will be described.

<Operation at the Time of Both-Surface Printing When the Sheet Size is Large>

Figure 2:
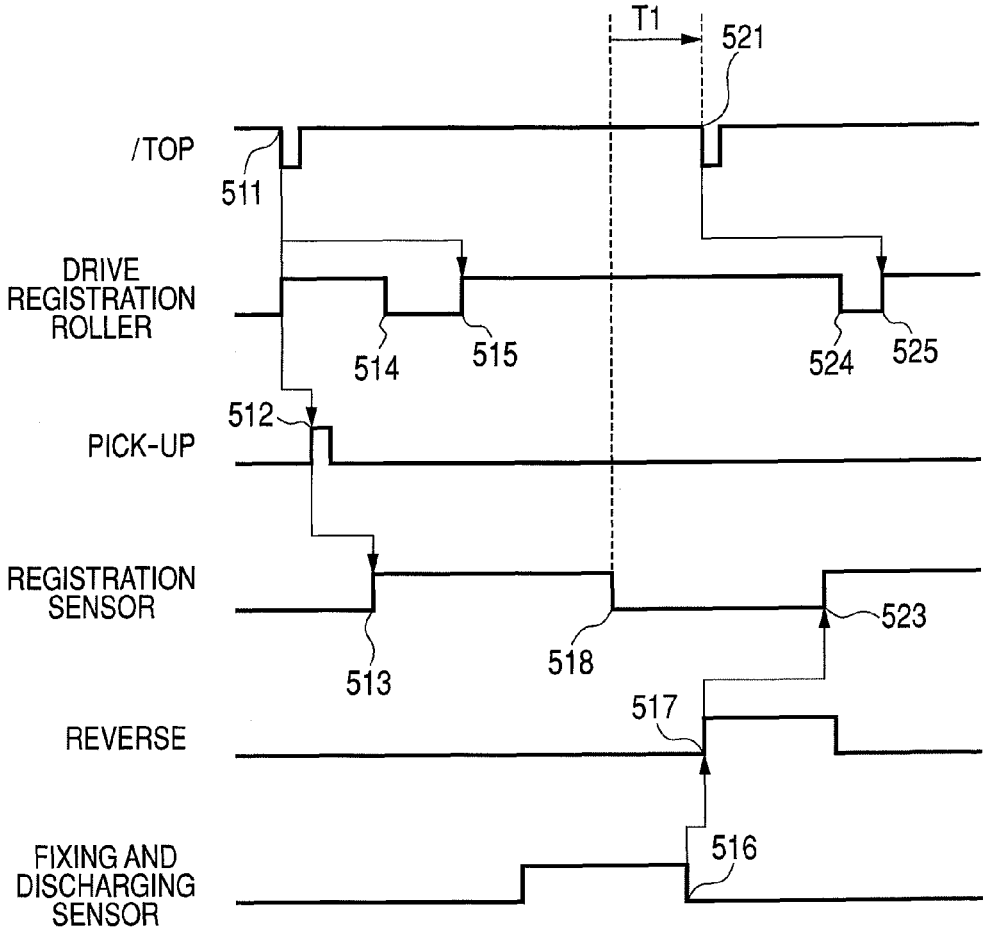
FIG. 2 is a diagram illustrating an operation when a sheet size is large at the time of both-surface printing in embodiment 1.

FIG. 2 is a timing chart of a both-surface printing operation when the present embodiment is applied when the size in the conveying direction of the sheet which is actually set at the sheet feeding cassette 1 is larger than the sheet size designated by the controller control part 201. The engine control part 202 outputs the /TOP signal of the first surface (511), starts a sheet feeding operation (512), and at a point of time (513) when the sheet 2 which is picked up reaches the registration roller 20, the engine control part 202 temporarily stops (514) sheet conveyance. Subsequently, the engine control part 202 restarts (515) sheet conveyance in synchronism with the toner image formed on the intermediate transfer belt 12, and transfers the toner image onto the sheet 2. The engine control part 202 outputs (521) the /TOP signal of the second surface at the timing when T1 has passed after the rear end of the sheet comes out of the registration sensor 22 (518) at the time of image formation of the first surface. The engine control part 202 reverses (517) the sheet and draws the sheet into the both-surface conveyance path, after conveying the sheet to the position where the rear end of the sheet of the first surface comes out of the fixing and discharging sensor 24 (516) and the sheet can be reversed. Subsequently, the engine control part 202 temporarily stops (524) sheet conveyance at a point of time (523) when the leading end of the sheet of the second surface reaches the registration roller 20, and restarts (525) sheet conveyance in synchronism with the toner image formed on the intermediate transfer belt 12 to transfer the toner image onto the sheet.

<Flowchart of Both-Surface Printing Operation>

Figure 3:
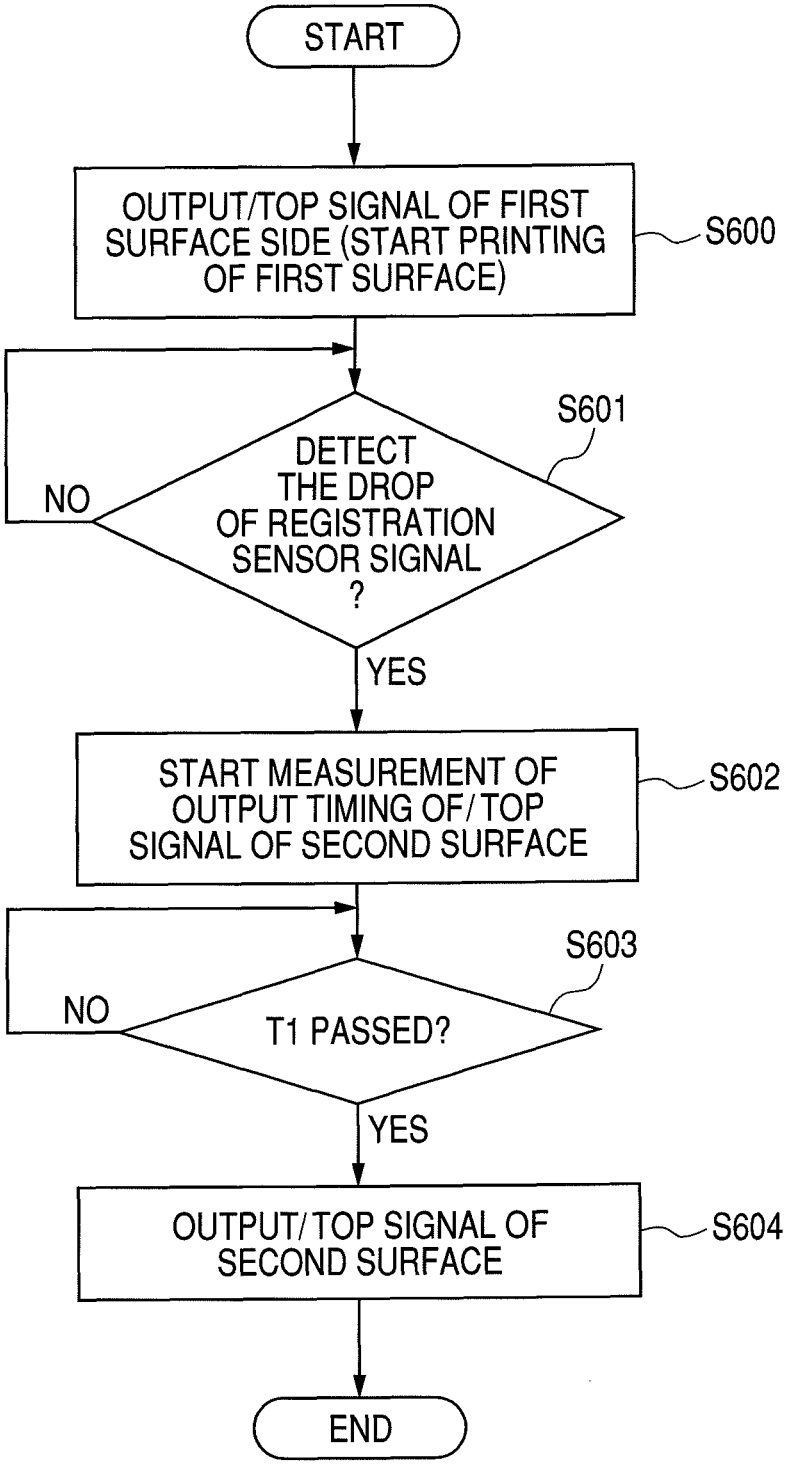
FIG. 3 is a flowchart at the time of both-surface printing in embodiment 1.

FIG. 3 is a flowchart at the time of a printing operation of the present embodiment. After outputting the /TOP signal of the first surface to start a printing operation of the first surface (step 600, hereinafter described as S600), the engine control part 202 monitors the timing at which the rear end of the sheet of the first surface comes out of the registration sensor 22, that is, a drop of the output signal of the registration sensor 22 (S601). After detecting the drop, the engine control part 202 starts measurement of the /TOP signal output timing of the second surface (S602), and monitors arrival of the timing, that is, whether T1 has passed (S603). The engine control part 202 outputs the /TOP signal of the second surface at the point of time when T1 has passed (S604).

From what is described above, after a lapse of time in which the toner image can be secondarily transferred synchronously onto the second surface of the second surface sheet after the rear end of the first surface of the sheet comes out of the registration sensor 22, the engine control part 202 outputs the /TOP signal of the second surface. Thereby, even when the size in the conveying direction of the sheet which is actually set at the sheet feeding cassette 1 is larger than the size designated by the controller control part 201, jamming and a print error are not caused. In addition, both-surface printing can be performed with the highest throughput corresponding to the size of the sheet which is set at the sheet feeding cassette 1.

It is to be understood that various modifications of the above described embodiment can be made based on the spirit of the present invention and these modifications are not excluded from the scope of the invention.

Embodiment 2

Embodiment 1 has the configuration in which the time until the leading end of the toner image reaches the secondary transfer position 13 after image formation is started is shorter than the time until the leading end of the reversed sheet reaches the secondary transfer position 13 after the rear end of the first surface of the sheet comes out of the registration sensor 22 and is reversed. In this case, the /TOP signal is output based on the timing at which the rear end of the sheet comes out of the registration sensor, and both-surface printing can be performed with the highest throughput corresponding to the size of the set sheet without causing a printing error.

Figure 4:
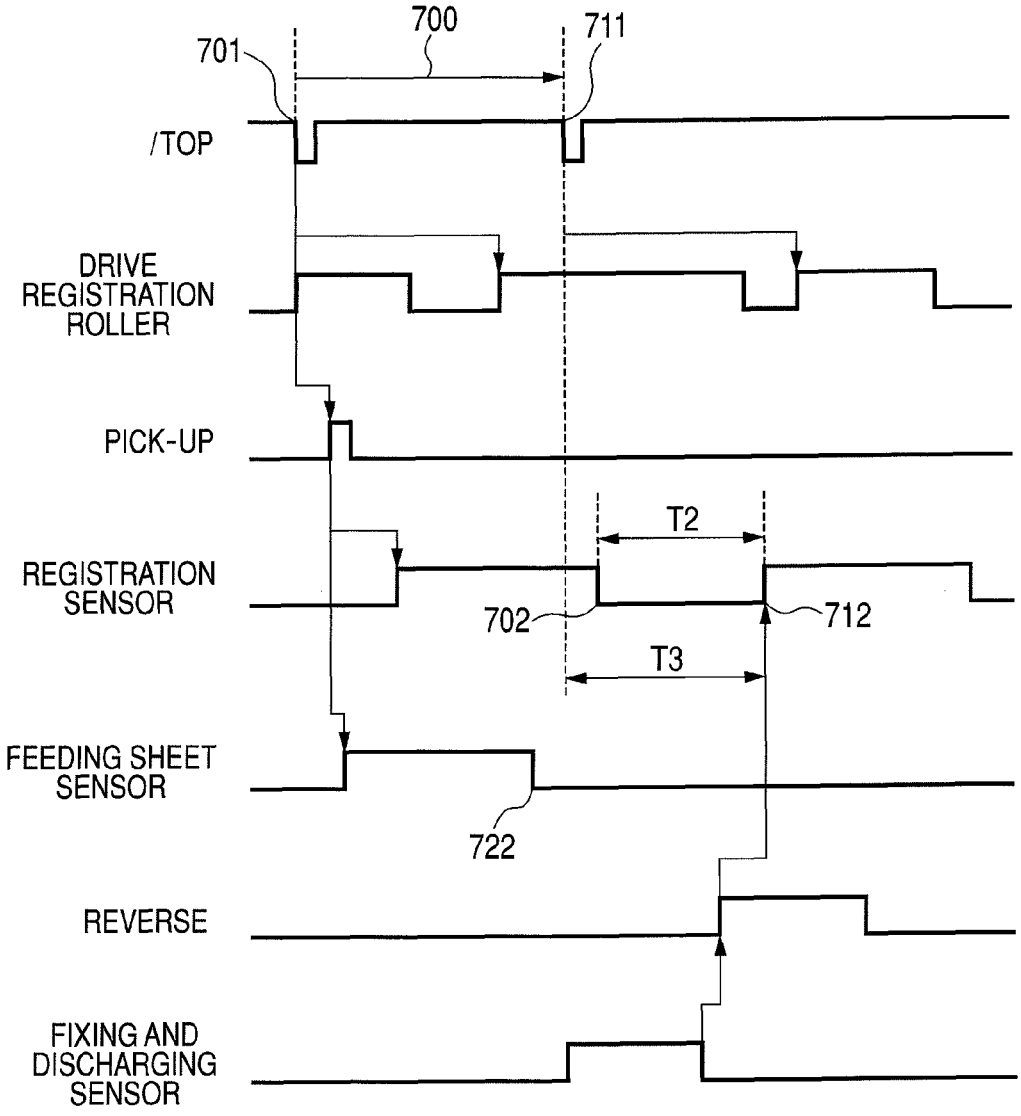
FIG. 4 is a diagram illustrating a basic operation at a time of both-surface printing in embodiment 2.

Embodiment 2 is based on the premise that the above described time relation is opposite, that is, the configuration in which the time until the leading end of the toner image reaches the secondary transfer position 13 after image formation is started is longer than the time until the leading end of the reversed sheet reaches the secondary transfer position 13 after the rear end of the sheet comes out of the registration sensor 22 and is reversed. A method will be described, which can perform both-surface printing with the highest throughput corresponding to the sheet size (the time interval of 700 in FIG. 4 is made as short as possible) in such a configuration. More specifically, the method uses a sensor on the conveyance path which is arranged at an upstream (upstream side in the conveying direction) from the registration sensor 22. At this time, the time until the leading end of the toner image reaches the secondary transfer position 13 after the image formation is started is arranged to be shorter than the time until the sheet is reversed and the leading end of the reversed sheet reaches the secondary transfer position 13 after the sensor senses the rear end of the first surface of the sheet. In the present embodiment, the engine control part 202 (determining unit) determines the timing of outputting the /TOP signal of the second surface with the timing at which the rear end of the first surface of the sheet comes out of the sensor on the aforementioned conveyance path as the reference. Hereinafter, description will be made by using a feeding sheet sensor 21 (feeding detection unit) which detects the transfer material 2 fed from the sheet feeding cassette 1 as the aforementioned sensor on the conveyance path. The components of the image forming apparatus are the same as those in FIGS. 8 and 9, and description thereof will be omitted. The image forming apparatus will be described by using the same reference numerals and characters hereinafter.

<Basic Operation of the Second Surface at the Time of Both-Surface Printing>

FIG. 4 is a timing chart in the case of realizing both-surface printing with the highest throughput in the above described configuration. Each of timing is substantially the same as the timing in FIG. 1, and only a characteristic part in the present embodiment will be described hereinafter. Since the feeding sheet sensor 21 is used in the present embodiment, FIG. 4 illustrates a timing chart of the feeding sheet sensor 21 additionally. The /TOP signal output timing of the second surface in the present embodiment will be described based on FIG. 4.

In the present embodiment, T2 and T3 in FIG. 4 corresponding to FIG. 1 are constant irrespective of the sheet size. However, the relationship of them is opposite to that of embodiment 1, and satisfies T2<T3.

Accordingly, in the present embodiment, output timing of the /TOP signal of the second surface is controlled by using the feeding sheet sensor 21.

Meanwhile, the time until a sheet rear end comes out of the registration sensor 22 (702) after the sheet rear end comes out of the feeding sheet sensor 21 (722) at the time of image formation of the first surface is constant. Therefore, a time T2' until the sheet rear end is reversed and reaches the registration sensor 22 (712) after the sheet rear end comes out of the feeding sheet sensor 21 (722) is constant irrespective of the sheet size, and satisfies T2'>T3.

Accordingly, in the present embodiment, the /TOP single output timing (711) of the second surface is set at the timing when a time of T1' which is the difference between T2' and T3 has passed after the timing (722) at which the sheet comes out of the feeding sheet sensor 21. Thereby, both-surface printing is performed with the highest throughput corresponding to the sheet size. T2' and T3 are both constant irrespective of the sheet size, and therefore, T1' is also constant. At a timing 701, the /Top signal of the first surface is output.

<Operation at the Time of Both-Surface Printing When Sheet Size is Large>

Figure 5:
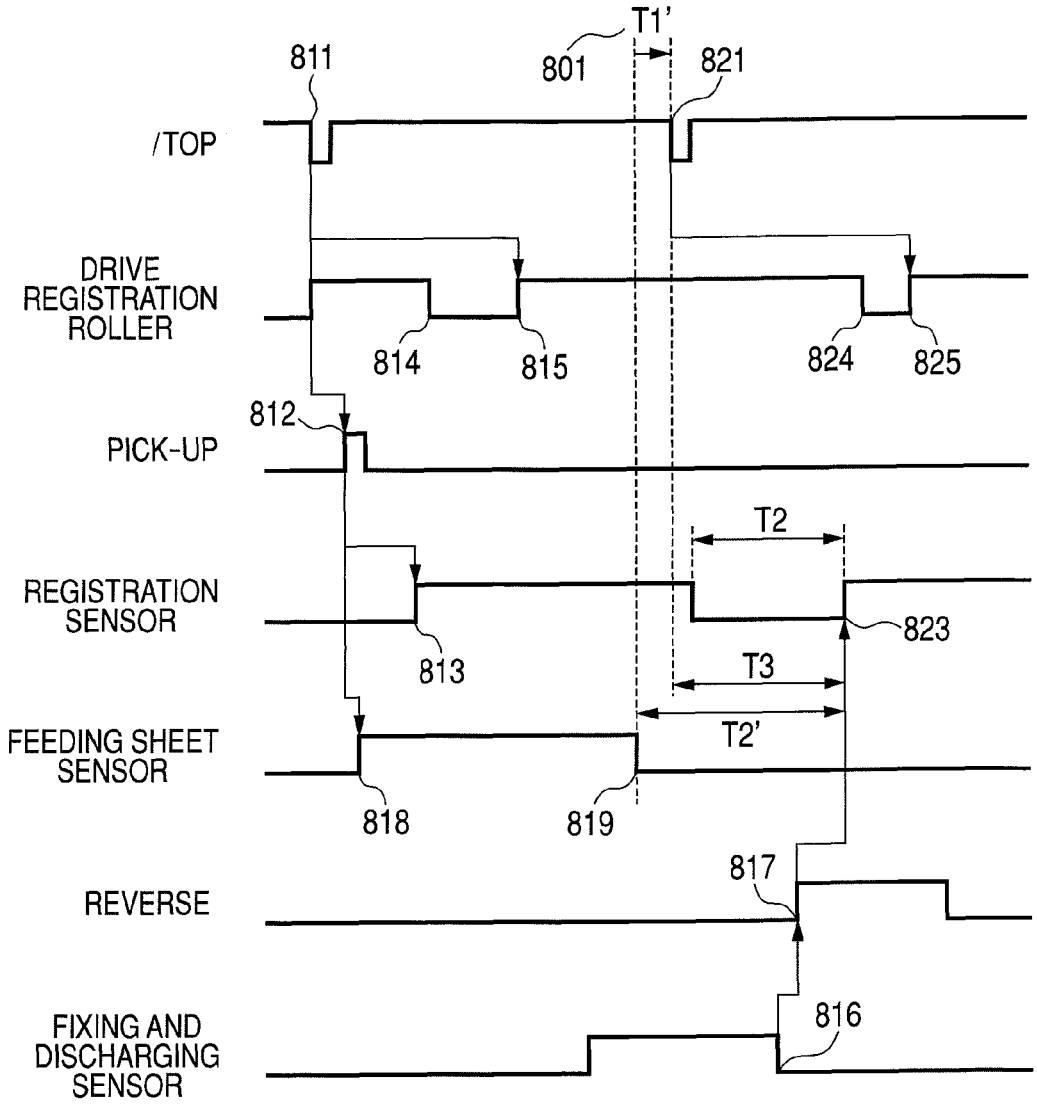
FIG. 5 is a diagram illustrating an operation when a sheet size is large at the time of both-surface printing in embodiment 2.

FIG. 5 is a timing chart of a both-surface printing operation when the present embodiment is applied to the case where the size in the conveying direction of the sheet which is actually set at the sheet feeding cassette 1 is larger than the sheet size designated by the controller control part 201.

The engine control part 202 outputs (811) the /TOP signal of the first surface, and starts (812) a sheet feeding operation. At the point of time (813) when the leading end of the sheet which is picked up reaches (818) the feeding sheet sensor 21, and thereafter, reaches the registration roller 20, the engine control part 202 temporarily stops (814) sheet conveyance. Subsequently, the engine control part 202 restarts (815) sheet conveyance in synchronism with the toner image formed on the intermediate transfer belt 12, and transfers the toner image onto the sheet 2. The engine control part 202 outputs (821) the /TOP signal of the second surface at a timing when T1' (801) has passed after the sheet rear end of the first surface comes out of the feeding sheet sensor 21 (819).

In the present embodiment, the time until the sheet rear end comes out of the registration sensor 22 (823) after the sheet rear end comes out of the feeding sheet sensor 21 (819) at the time of image formation of the first surface is constant. Therefore, a time T2' until the sheet rear end is reversed and reaches the registration sensor 22 (823) after the sheet rear end comes out of the feeding sheet sensor 21 (819) is constant irrespective of the sheet size, and T2'>T3 is satisfied. Accordingly, in the present embodiment, the /TOP signal output timing (821) of the second surface is set at the timing when a time T1' which is the difference between T2' and T3 has passed from the timing (819) when the sheet comes out of the feeding sheet sensor 21. As a result, both-surface printing is performed with the highest throughput corresponding to the sheet size. Since T2' and T3 are both constant irrespective of the sheet size, T1' is also constant.

The engine control part 202 conveys the sheet 2 to the position where the sheet rear end of the first surface comes out of the fixing and discharging sensor 24 (816) and the sheet can be reversed, and thereafter, reverses the sheet (817) and draws the sheet into the both-surface conveyance path. Subsequently, the engine control part 202 temporarily stops (824) sheet conveyance at the point of time (823) when the sheet leading end of the second surface reaches the registration roller 20, restarts (825) sheet conveyance in synchronism with the toner image formed on the intermediate transfer belt 12, and transfers the toner image onto the sheet 2.

<Flowchart of Both-Surface Printing Operation>

Figure 6:
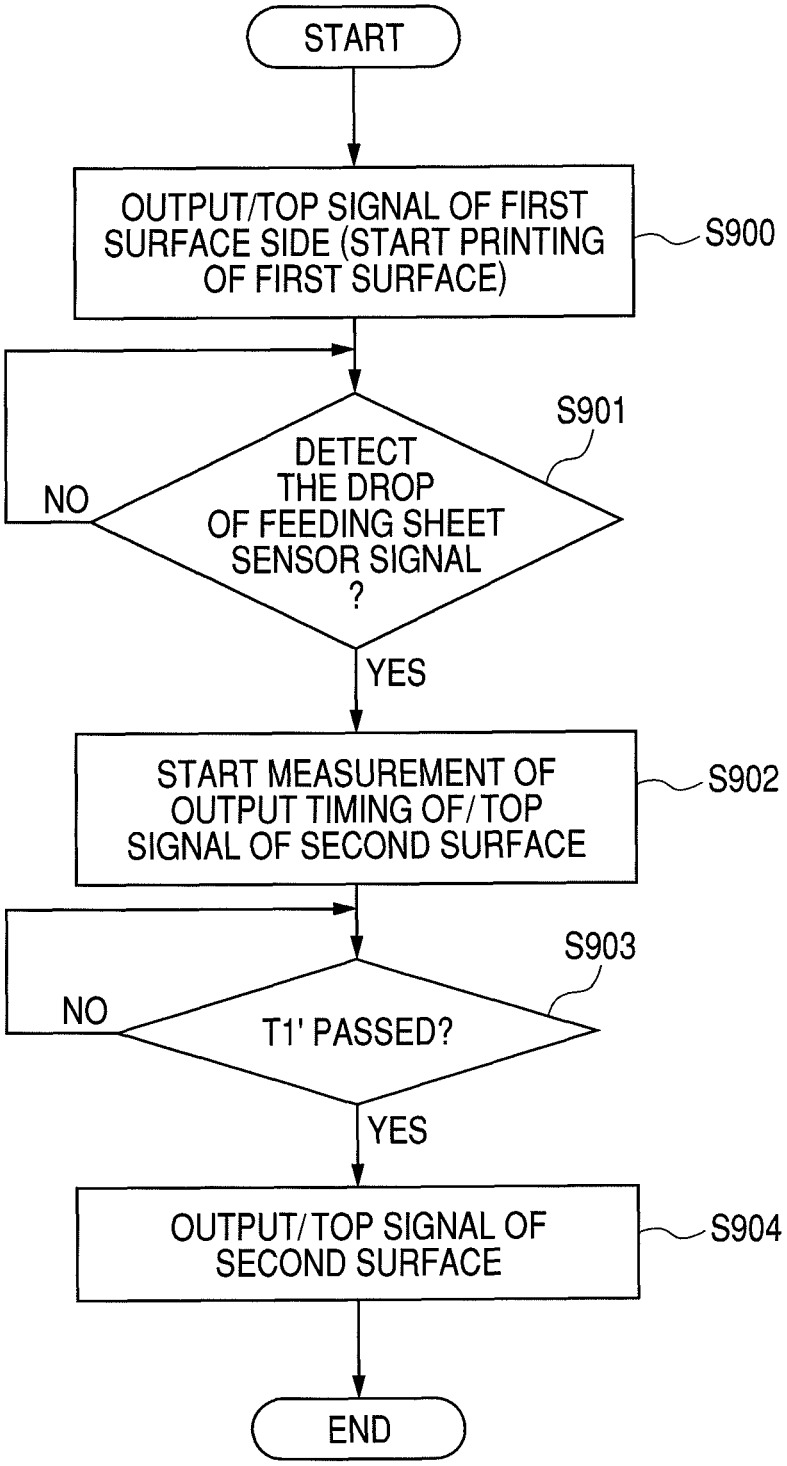
FIG. 6 is a flowchart at the time of both-surface printing in embodiment 2.

FIG. 6 is a flowchart at the time of a printing operation of the present embodiment.

The engine control part 202 outputs the /TOP signal of the first surface and starts a printing operation of the first surface (S900), and monitors the timing at which the sheet rear end comes out of the feeding sheet sensor 21 at the time of image formation of the first surface, that is, the drop of the output signal of the feeding sheet sensor 21 (S901). After detecting the drop, the engine control part 202 starts measurement of the /TOP signal output timing of the second surface (S902), and always monitors arrival of the timing, that is, whether T1' has passed (S903). At the point of time when T1' has passed, the engine control part 202 outputs the /TOP signal of the second surface (S904).

From what is described above, after a lapse of time in which the toner image can be secondarily transferred onto the second surface of the sheet synchronously after the rear end of the first surface of the sheet comes out of the feeding sheet sensor 21, the engine control part 202 outputs the /TOP signal of the second surface. Thereby, even when the size in the conveying direction of the sheet which is actually set at the sheet feeding cassette 1 is larger than the size designated by the controller control part 201, jamming and a printing error are not caused. Both-surface printing can be performed with the highest throughput corresponding to the size of the sheet which is set at the sheet feeding cassette 1.

It should be understood that various modifications of the above described embodiment can be made based on the spirit of the present invention, and these modifications are not excluded from the scope of the invention.

Embodiment 3

In embodiments 1 and 2, attention is focused on the size (sheet size) in the conveying direction of the sheet. The /TOP signal output timing of the second surface for realizing the highest throughput is described. The timing is the /TOP signal output timing of the second surface based on the sheet size, and the timing of starting image formation of the second surface.

In the present embodiment, the /TOP signal output timing of the second surface will be described. The /TOP signal output timing is for realizing the highest throughput with consideration also being given to the size (hereinafter, described as "sheet width") in a direction (also called a main scanning direction) vertical to the conveying direction of the sheet in addition to the sheet size. The components of the image forming apparatus are the same as those in FIGS. 8 and 9, and explanation thereof will be omitted. The image forming apparatus will be described by using the same reference numerals and characters hereinafter.

When the sheet width is narrow (the length in a direction vertical to the conveying direction of the transfer material is shorter than a predetermined length), the temperature rises in a sheet non-passing area (also called an end portion) which is an area where the transfer material does not pass in the fixing device 14. In such a case, a control is conducted for suppressing temperature rise of the end portion by increasing a time in which the sheet is not passed to the fixing device 14 by increasing an image formation interval (called throughput down control). The control is known, and therefore, the detailed description will be omitted. When the /TOP signal output timing of the second surface in the case of applying this control is later than the /TOP signal output timing of the second surface based on the sheet size (late timing), the /TOP signal output of the second surface needs to be delayed to the former timing. The /TOP signal output timing of the second surface when control of suppressing the temperature rise of the end portion is applied is described as "/TOP signal output timing of the second surface based on the sheet width (timing of starting image formation)".

In the following description, the case of outputting the /TOP signal of the second surface after a predetermined time passes after the sheet rear end comes out of the registration sensor 22, which is described in embodiment 1, will be described as an example.

<Flowchart of the Both-Surface Printing Operation>

Figure 7:
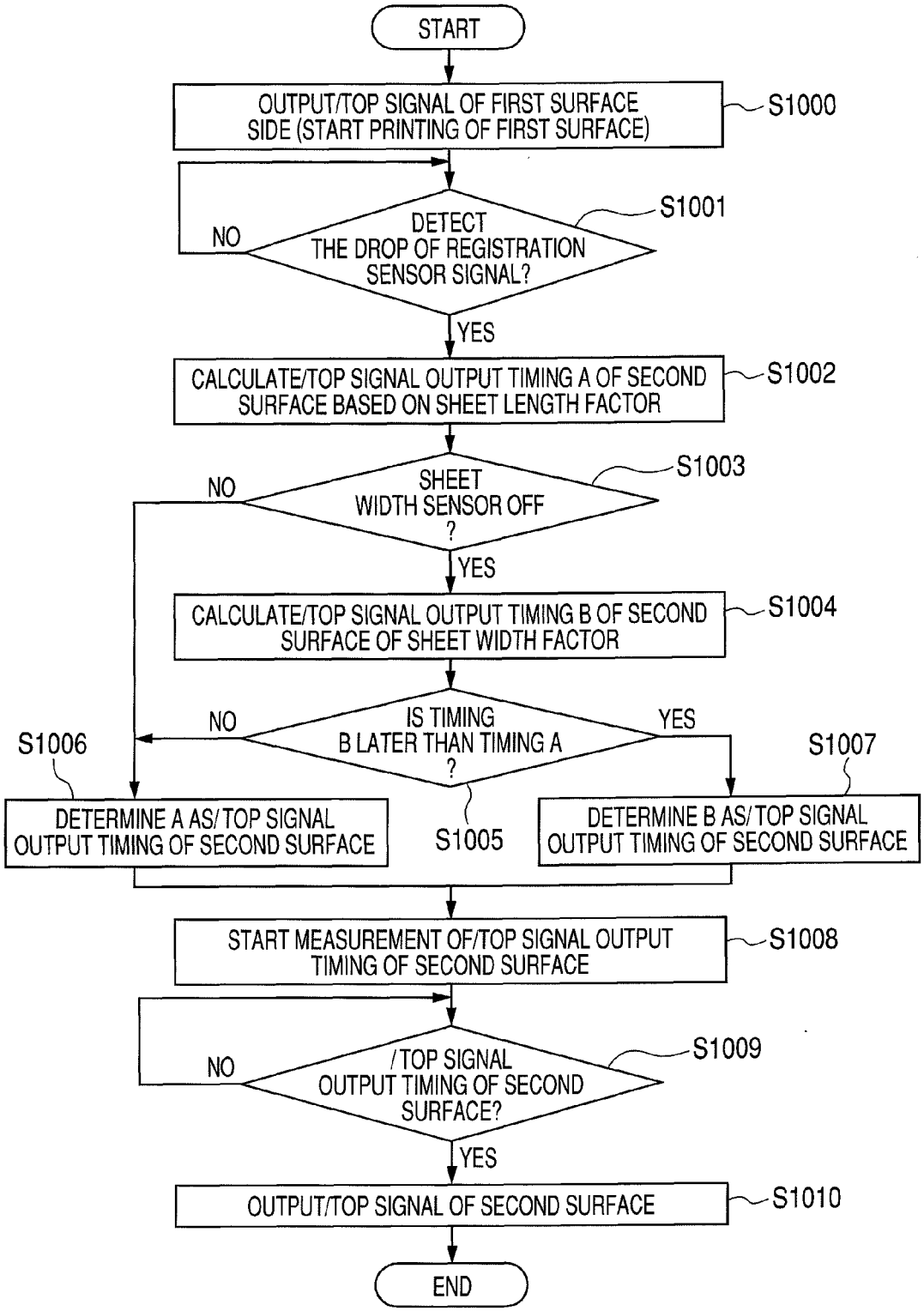
FIG. 7 is a flowchart at a time of both-surface printing in embodiment 3.

FIG. 7 is a flowchart at the time of a printing operation of the present embodiment.

The engine control part 202 outputs the /TOP signal of the first surface and starts the printing operation of the first surface (S1000), and monitors the timing at which the sheet rear end of the first surface comes out of the registration sensor 22, that is, a drop of the registration sensor 22 (S1001). The engine control part 202 calculates a /TOP signal output timing A of the second surface of a sheet length factor at the timing when detecting a drop (S1002).

Thereafter, the engine control part 202 checks the state of a sheet width sensor (transfer material width detecting unit) which detects a sheet width not illustrated (sheet width sensor off (OFF): sheet width is narrow) (S1003). Here, when the sheet width sensor is on, the engine control part 202 determines that the sheet width is large, and a temperature rise does not occur to the end portion of the fixing device 14. Therefore, the engine control part 202 determines the /TOP signal output timing of the second surface to be the timing A which is calculated in S1002 (S1006). Meanwhile, when the sheet width sensor is off, the engine control part 202 determines that the sheet width is narrow, and temperature rise occurs in the end portion of the fixing device 14. Therefore, the engine control part 202 calculates a /TOP signal output timing B of the second surface based on the sheet width (S1004). Subsequently, the engine control part 202 compares the timing B and the timing A (S1005), and when the timing A is later than the timing B, the engine control part 202 determines the /TOP signal output timing of the second surface as the timing A calculated in S1002 (S1006). Meanwhile, when the timing B is later, the engine control part 202 determines the /TOP signal output timing of the second surface as the timing B calculated in S1004 (S1007).

The engine control part 202 starts measurement of the timing after determining the /TOP signal output timing of the second surface in S1006 or S1007 (S1008), and monitors arrival of the timing (S1009). Subsequently, the engine control part 202 outputs the /TOP signal of the second surface at the point of time when the TOP signal output timing of the second surface arrives (S1010).

From what is described above, when the sheet width is small, the engine control part 202 outputs the /TOP signal of the second surface after the time with consideration being given to the sheet size and sheet width has passed after the rear end of the first surface of the sheet comes out of the registration sensor 22. Thereby, even when the size in the conveying direction of the sheet which is actually set at the sheet feeding cassette 1 is longer than the size designated by the controller control part 201, jamming and a printing error are not caused. Both-surface printing can be performed with the highest throughput corresponding to the sheet which is set at the sheet feeding cassette 1 with the temperature rise in the end portion of the fixing device 14 being suppressed.

In the present embodiment, the case is described as an example, in which the /TOP signal of the second surface is output after a predetermined time passes after the sheet rear end comes out of the registration sensor 22. However, the present embodiment also can be applied to the case in which the /TOP signal of the second surface is output after a predetermined time passes after the sheet rear end comes out of the feeding sheet sensor 21 described in embodiment 2. In this case, the drop of the output signal of the feeding sheet sensor 21 is monitored in S1001 of FIG. 7.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2008-142836, filed May 30, 2008, and 2009-117594, filed May 14, 2009, which are hereby incorporated by reference herein in their entirety.

What is claimed is:

1. An image forming apparatus, comprising:

an image forming part that forms an image on an image bearing member;

an intermediate transfer member onto which the image formed on the image bearing member is transferred;

a transfer part that transfers the image formed on the intermediate transfer member onto a recording material;

a conveying part that conveys the recording material;

a detection part that detects the recording material which is conveyed by the conveying part;

a reversing-conveying part that reverses the recording material on which an image is formed on a first surface of the recording material after the image is formed on the first surface of the recording material, and conveys the recording material to the transfer part again so as to form an image on a second surface of the recording material; and a control unit that controls timing for starting an image formation by the image forming part, wherein the control unit determines a size of the recording material in a direction in which the conveying part conveys the recording material based on information from a detection result of the detection part, wherein the control unit controls an operation of the image forming part so that, in a case where the size obtained by the control unit is the same as a designated size, an image formation on the second surface is started after a predetermined time lapses from a start timing when an image formation on the first surface of the recording material starts, and in a case where the size obtained by the control unit is larger than a designated size, an image formation on the second surface is started according to a timing of detection by the detection part when a trailing edge of the recording material that is conveyed and whose size is the larger, and without reference to the start timing of the image formation on the first surface, whereby an interval between an image to be formed on the first surface of the recording material and an image to be formed on the second surface of the recording material, on the intermediate transfer member in the case where the size obtained by the control unit is larger than the designated size, is larger than the interval in the case where the size obtained by the control unit is the same as the designated size.

2. An image forming apparatus according to claim 1, wherein in a case where the control unit determines that a size of a conveyed recording material in a direction perpendicular to the conveyance direction is smaller than a predetermined size, the control part switches a timing for starting image formation by the image forming part to a timing later than the timing for starting the image formation for the second image based on the designated size of the recording material in the conveyance direction, and wherein the control part compares the later timing to the timing for starting the image formation for the second image determined in response to the timing of detecting the trailing edge of the recording material by the detection part, and starts an image formation for the second image by a later timing between the later timing and the timing for starting the image formation for the second image determined in response to the timing of detecting the trailing edge of the recording material by the detection part.

3. An image forming apparatus according to claim 2, wherein in a case where a size of the recording material in a conveying direction is larger than a designated size, said image forming part forms on the image bearing member the second image to be transferred to the second surface of the recording material according to the timing of detecting the trailing edge of the recording material by the detection part.

4. An image forming apparatus according to claim 1, wherein the detection part is a sensor used for synchronizing an image formed on the intermediate transfer member and a recording material, and wherein said image forming part starts forming on the image bearing member the second image to be transferred to the second surface of the recording material after a predetermined time passes from a timing when the sensor detects a trailing edge of the recording material.

5. An image forming apparatus according to claim 1, wherein the detection part is a sensor that detects a fed transfer material, and wherein said image forming part starts forming on the image bearing member the second image to be transferred to the second surface of the recording material after a predetermined time passes from a timing when the sensor detects a trailing edge of the recording material.

6. An image forming apparatus according to claim 1, wherein the timing of detecting the trailing edge of the recording material is changed in a case where a size of the recording material in a direction perpendicular to the conveying direction is smaller than a predetermined size.

7. An image forming apparatus according to claim 1, further comprising a plurality of the image bearing members, wherein toner images of different colors are formed on the respective image bearing members, and the formed toner images of different colors are multiple-transferred onto the intermediate transfer member.

8. An image forming apparatus comprising:

an image bearing member on which an image is formed;

an image forming part that forms an image on said image bearing member;

a transfer part that transfers the image formed on the image bearing member onto a recording material;

a detection part that detects the recording material;

a reversing-conveying part that reverses the recording material on which an image is formed on a first surface of the recording material after the image is formed on the first surface of the recording material, and conveys the recording material to the transfer part again so as to form an image on a second surface of the recording material; and a control unit that receives information from the detection part and controls timing for starting an image formation by the image forming part, wherein the control unit controls an operation of the image forming part so that, in a case where the size obtained based on size detection information from the detection part is the same as a designated size in a conveyance direction, an image formation on the second surface is started after a predetermined time lapses from a start timing when an image formation on the first surface of the recording material starts, and in a case where the size obtained based on size detection information from the detection part is larger than a designated size, an image formation on the second surface is started according to a timing of detection by the detection part when a trailing edge of the recording material that is conveyed and whose size is the larger, and without reference to a start timing of the image formation on the first surface, whereby an interval between an image to be formed on the first surface of the recording material and an image to be formed on the second surface of the recording material, in the case where the size obtained by the control unit is larger than the designated size, is larger than the interval in the case where the size obtained by the control unit is the same as the designated size.

9. An image forming apparatus according to claim 8, wherein said image forming part forms on the image bearing member the second image to be transferred to the second surface of the recording material at a timing in response to a detection of a trailing edge of the recording material in a case where a size of the recording material in a conveying direction is larger than the designated size.

10. An image forming apparatus according to claim 8, wherein the detection part is a sensor used for synchronizing an image formed on the image bearing member and a recording material, and wherein said image forming part starts forming on said image bearing member the second image to be transferred to the second surface of the recording material after a predetermined time passes from a timing when the sensor detect a trailing edge.

11. An image forming apparatus according to claim 8, wherein the detection part is a sensor that detects a fed recording material, and wherein said image forming part starts on the image bearing member forming the second image to be transferred to the second surface of the recording material after a predetermined time passes from a timing when the sensor detect a trailing edge of the recording material.

12. An image forming apparatus according to claim 8, further comprising a plurality of the image bearing members, wherein toner images of different colors are formed on the respective image bearing members, and the formed toner images of different colors are multiple-transferred onto the image bearing member.

* * * * *